US009622557B1

(12) United States Patent
Beavers et al.

(10) Patent No.: US 9,622,557 B1
(45) Date of Patent: Apr. 18, 2017

(54) MOBILE DEVICE ATTACHMENT APPARATUS

(71) Applicants: John F. Beavers, Lake Worth, FL (US); Gary Bowers, Lake Worth, FL (US)

(72) Inventors: John F. Beavers, Lake Worth, FL (US); Gary Bowers, Lake Worth, FL (US)

(73) Assignee: GBJB INTERNET HOLDINGS, LLC, Lake Worth, FL (US)

( * ) Notice: Subject to any disclaimer, the term of this patent is extended or adjusted under 35 U.S.C. 154(b) by 36 days.

(21) Appl. No.: 14/452,721

(22) Filed: Aug. 6, 2014

Related U.S. Application Data

(60) Provisional application No. 61/870,515, filed on Aug. 27, 2013.

(51) Int. Cl.
*A45F 5/00* (2006.01)
*A45C 11/00* (2006.01)

(52) U.S. Cl.
CPC ..... *A45C 11/00* (2013.01); *A45C 2011/002* (2013.01); *A45C 2011/003* (2013.01)

(58) Field of Classification Search
CPC ..... A45F 2200/0516; A45F 2005/008; A45F 2005/025; A45F 5/00; A45F 5/02; A45F 5/021; H04B 1/385; H04B 1/3888; H04B 2001/3855; A45C 2011/002; Y10S 224/93
USPC ..... 224/197, 219, 222
See application file for complete search history.

(56) References Cited

U.S. PATENT DOCUMENTS

| | | | | |
|---|---|---|---|---|
| 4,433,498 | A * | 2/1984 | Bienz | G09F 3/0358 24/3.6 |
| 4,509,667 | A * | 4/1985 | Meldrum | A45F 5/00 224/222 |
| D482,671 | S | 11/2003 | DiDonato | |
| 6,796,467 | B2 | 9/2004 | Caldana | |
| D519,731 | S | 5/2006 | Andre et al. | |
| D555,353 | S | 11/2007 | Kennedy | |
| 7,424,110 | B1 | 9/2008 | Whiten, III | |
| 8,016,492 | B2 | 9/2011 | Pyle | |
| 8,140,131 | B1 | 3/2012 | Green | |
| 8,196,792 | B2 * | 6/2012 | Clifton, Jr. | A45F 5/00 224/661 |
| 8,328,055 | B1 | 12/2012 | Snyder | |
| 2003/0164389 | A1 | 9/2003 | Byers | |
| 2005/0277452 | A1 * | 12/2005 | Pasamba | H04B 1/385 455/575.6 |

(Continued)

*Primary Examiner* — Adam Waggenspack
(74) *Attorney, Agent, or Firm* — Glenn E. Gold; Glenn E. Gold, P.A.

(57) ABSTRACT

A mobile device attachment apparatus comprising a flexible attachment strap adapting the apparatus to be worn on a user and a support member providing a platform for receiving and releasably retaining a mobile electronic device. The attachment apparatus also includes a rotatable dial member and a base panel. The base panel is attached to the flexible attachment strap and the rotatable dial member is rotatably mounted to the base panel. The support member is releasably attached to the rotatable dial member by engagement with at least one flexible arm of the rotatable dial member. A detent mechanism is provided to allow the rotatable dial member, including the support member and attached electronic device, to rotate relative to the base panel, and thus to the user, in discrete rotational increments.

15 Claims, 10 Drawing Sheets

(56) References Cited

U.S. PATENT DOCUMENTS

| | | | | |
|---|---|---|---|---|
| 2006/0166720 | A1 | 7/2006 | Dixon | |
| 2006/0186150 | A1 | 8/2006 | Willows et al. | |
| 2007/0170216 | A1 | 7/2007 | Davis | |
| 2008/0164291 | A1* | 7/2008 | Goradesky | A45F 5/02 224/269 |
| 2009/0140016 | A1* | 6/2009 | Case | A45F 5/02 224/197 |
| 2009/0321483 | A1 | 12/2009 | Froloff | |
| 2012/0080462 | A1* | 4/2012 | Hajarian | A45F 5/00 224/219 |

* cited by examiner

MOBILE DEVICE ATTACHMENT APPARATUS

CROSS REFERENCE(S) TO RELATED APPLICATION(S)

This U.S. non-provisional patent application claims the benefit of U.S. provisional patent application No. 61/870,515, filed on Aug. 27, 2013, the entire contents of which are incorporated herein by reference thereto.

FIELD OF THE INVENTION

The present invention relates to a mobile device attachment apparatus for releasably retaining a mobile electronic device on an arm of a user. More specifically, the present invention relates to an attachment apparatus for releasably retaining an electronic device on the arm of the user while allowing full use of all controls and viewing positions of the electronic device.

BACKGROUND OF THE INVENTION

Mobile electronic devices are increasingly being employed by people as they go about their day. Some of these devices may include cellular telephone or cell phones, global positioning systems or devices known as GPS's, mobile data devices such as tablet computers, radios with enhanced screen capabilities, cameras, etc. These devices typically have viewing screens that can be alternated or reoriented between landscape and portrait modes depending on the data being viewed. The more complex devices also include multiple controls and modes including volume and speaker functions.

Various carrying devices are available to carry these mobile electronic devices, such as, for example, hard and soft cases, belt clips, arm bands, etc. However, these carrying devices may not allow full use of all controls of the mobile electronic device or they may not allow the display to be rotated or re-oriented for full use of both the landscape and portrait viewing modes. Additionally, it is often necessary to completely remove the mobile electronic device from the carrier to access all the mobile electronic device functions or to hold the mobile electronic device proximate to an ear of the user for privacy during verbal communications.

Accordingly, there remains a need in the art for a mobile device attachment apparatus, which is capable of releasably retaining the mobile electronic device on the arm of the user, which is capable of allowing a display screen (alternately referred to herein as a "display" or a "screen") and accompanying controls of the mobile electronic device to be selectively rotated a full 360 degrees, facilitating viewing of the display and operation of the accompanying controls.

SUMMARY OF THE INVENTION

The present invention overcomes the deficiencies of the known art and the problems that remain unsolved by providing a mobile device attachment apparatus for releasably retaining a mobile electronic device on the arm of a user in a manner enabling selective rotation of the mobile electronic device by the user.

In accordance with one aspect of the present invention, a mobile device attachment apparatus includes:

- a flexible attachment strap adapting the apparatus to be worn by a user;
- a base panel coupled to the flexible attachment strap;

- a dial member rotatably mounted on the base panel; and
- a support member mounted on the dial member and rotatable with the dial member to a selected angular position relative to the base panel for providing a platform on which to retain a mobile electronic device so as to enable use by the user of the functions of the device.

In another aspect, the support member of the apparatus includes a body having a pair of inwardly curled opposite edge portions defining a pair of channels extending along the respective opposite edge portions and each inwardly curled edge portion provided with a respective notch extending completely therethrough. Optionally, one or more apertures, or holes, may be provided extending into or completely through the support member body for use releasably attaching an electronic mobile device to the support member.

In another aspect, the dial member is rotatably mounted to, and is disposed adjacent and spaced-apart from, the base panel of the mobile device attachment apparatus and includes a dial member body having a pair of opposite linear sides and a pair of flexible arms with integral outwardly projecting tabs, the flexible arms being mounted to the dial member body and respectively extending parallel to and in a spaced-apart relationship to the opposite linear sides, the flexible arms adapted to be flexed inwardly toward the opposite linear sides of the dial member body as the channels of the device support member are slid over the flexible arms of the rotatable dial member until the outwardly projecting tabs on the flexible arms are aligned with and releasably retained within the respective notches of the device support member body so as to releasably mount the mobile device support member about the rotatable dial member.

In accordance with another aspect of the present invention, a mobile device attachment apparatus includes:

- a flexible attachment strap adapting the apparatus to be worn by a user;
- a base panel coupled to the flexible attachment strap;
- a dial member rotatably mounted on the base panel;
- a detent mechanism defined by and extending between the base panel and the dial member so as to enable incremental rotational of the dial member relative to the base panel so as to place the dial member at any selected one of a plurality of angular positions relative to the base panel; and
- a support member mounted on the dial member and rotatable with the dial member to any selected one of the plurality of angular positions relative to the base panel for providing a platform on which to retain a mobile electronic device so as to enable use by the user of the functions of the device.

In another aspect, the detent mechanism of the apparatus includes a plurality of detent holes defined in one of the dial member and the base panel and a plurality of raised buttons defined on the other of the dial member and the base panel for engagement with a selected array of the plurality of detent holes so as to place the dial member at a selected one of a plurality of angular positions on and relative to the base panel.

In accordance with another aspect of the present invention, a mobile device attachment apparatus includes:

- a flexible attachment strap having an arm receiving portion adapting the apparatus to be worn by an arm of a user;
- a base panel coupled to spaced portions of the flexible attachment strap;
- a dial member rotatably mounted on the base panel;

a support member mounted on the dial member and rotatable with the dial member to a selected angular position relative to the base panel for providing a platform on which to retain a mobile electronic device so as to enable use by the user of the functions of the device; and a device security strap being affixed at opposite ends to the spaced portions of the flexible attachment strap and adapted to wrap around the mobile electronic device to secure the device on the platform of the support member.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
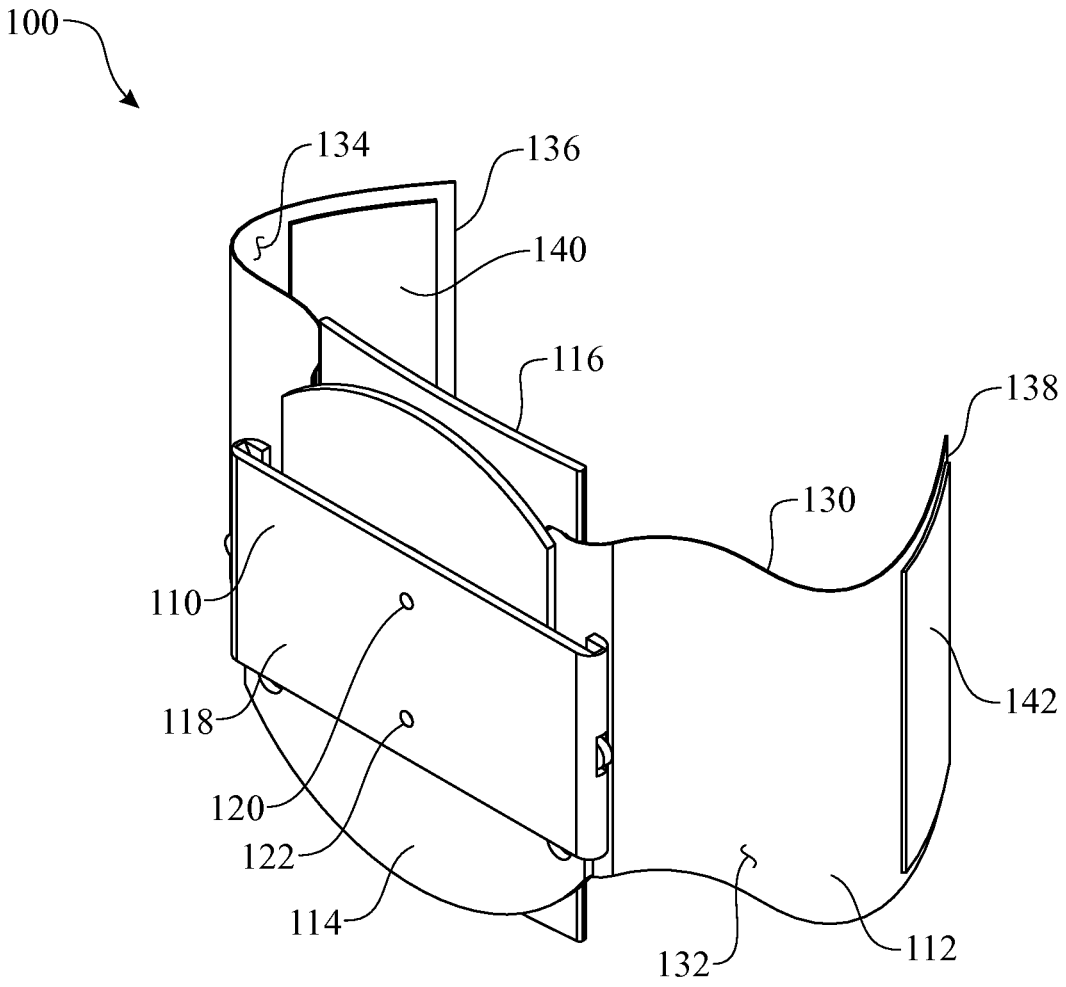
FIG. 1 presents an isometric assembled view of an exemplary embodiment of a mobile device attachment apparatus.

A mobile device attachment device or attachment apparatus 100, and associated components, are presented in the illustrations of FIGS. 1 through 11. The attachment apparatus 100 provides a secure platform wearable on an arm of a user on which to releasably retain mobile electronic devices that are normally handheld, such as, for example, cell phones, cell phone cases, GPS devices, radios or other display devices, so as to enable full use of all functions of the subject electronic device even while the user participates in other activities. Referring initially to FIG. 1, the attachment apparatus 100 includes a support member 110 for receipt of an electronic device 500 (FIGS. 8-10) and a flexible attachment strap 112 for releasably retaining the attachment apparatus 100 on the arm of the user as described in more detail hereinbelow. The attachment apparatus 100 additionally includes a rotatable dial member 114, which is releasably connected to the support member 110, and a base panel 116, which is attached to the flexible attachment strap 112.

The support member 110 is provided to releasably or semi-permanently retain an electronic device 500, or its supporting cover, holder, base, etc., on a flat exterior surface 118 of the support member 110. Additionally, holes 120 and 122 may be provided through the support member 110 to receive pins or rivets (not shown) of the electronic device 500 or its holder, etc. When the electronic device 500 is releasably connected to the flat exterior surface 118 of the support member 110, it may be attached thereto by various means such as, for example, hook and loop fastener, two-sided adhesive strip, or pins extending from a rear surface of an electronic device 500 that snap into the holes 120 and 122, etc. Permanent or semi-permanent connection of the electronic device 500 to the flat exterior surface 118 of the support member 110 may be accomplished by gluing, riveting or pinning through the holes 120 and 122 through the support member 110. It should be noted that the terms "flat surface" and "flat exterior surface" may be used interchangeable herein; however, they both refer to the same surface 118 of device support member 110.

Figure 2:
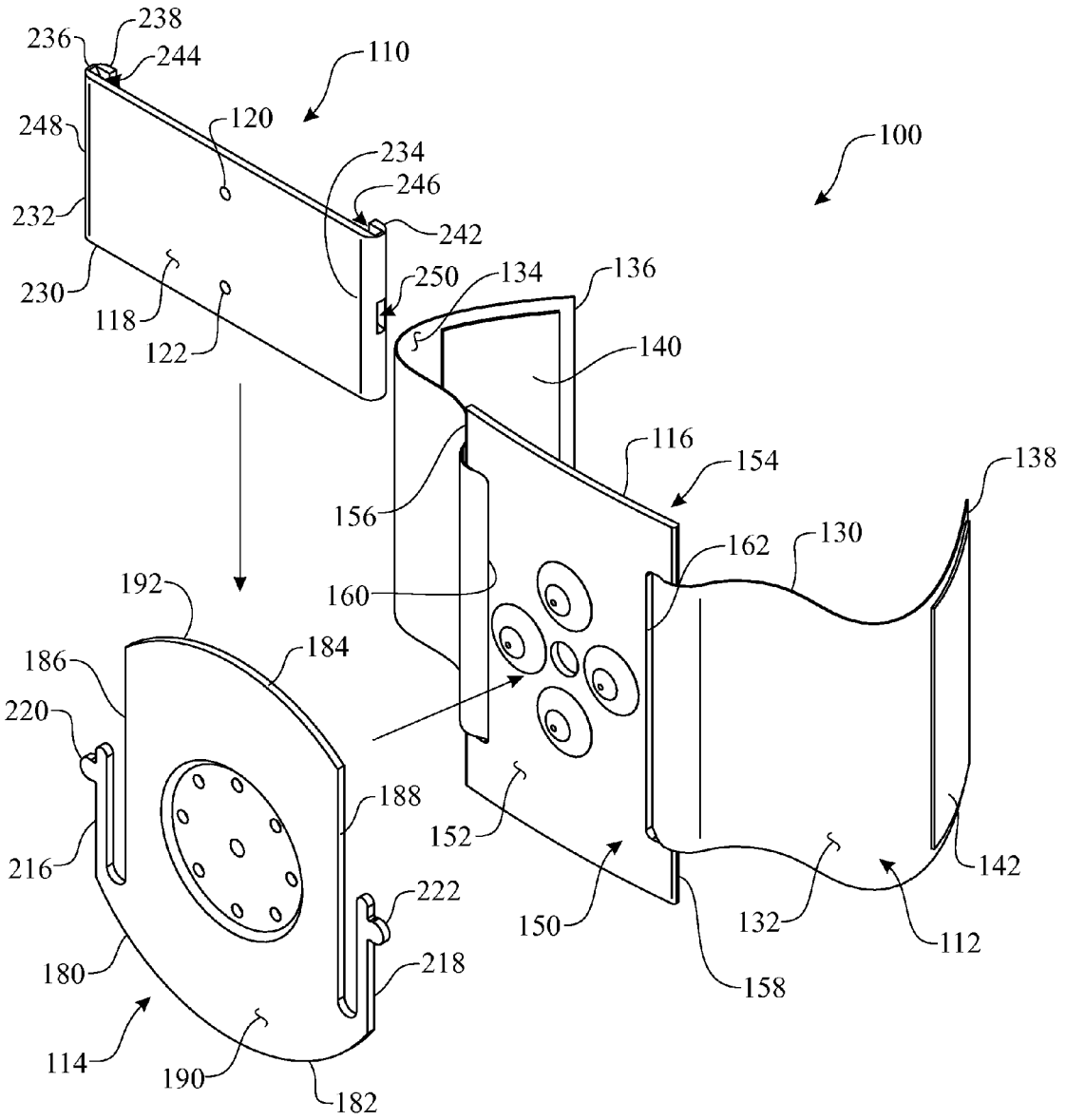
FIG. 2 presents an isometric exploded view of the mobile device attachment apparatus.

With reference now to FIGS. 1 and 2, the flexible attachment strap 112 includes a length of strip of flexible material 130 having an outer surface 132, an inner surface 134, a first end 136 and a second end 138. The strip of flexible material 130 may be formed from a variety of natural or synthetic materials, such as, for example, cotton or polymeric materials.

In order to releasably secure the attachment apparatus 100 about the arm of the user, the first end 136 of the strip of flexible material 130 is releasably connected to the second end 138 of the strip of flexible material 130. This may be accomplished by various means such as, for example, buckles, buttons, snap fasteners, and the like. In an exemplary embodiment, the first end 136 of the strip of flexible material 130 is releasably attached to the second end 138 of the strip of flexible material 130 by a "hook and loop" type fastener connection. Specifically, the inner surface 134 of the strip of flexible material 130 is provided with a strip of hook material 140 at the first end 136 and the outer surface 132 of the strip of flexible material 130 is provided with a strip of loop material 142 at the second end 138 of the strip of flexible material 130. This allows the first and second ends, 136 and 138, respectively, of the strip of flexible material 130 to be easily and releasably connected by engagement of the strip of hook material 140 with the strip of loop material 142.

As noted above, the strip of flexible material 130 may be formed from of variety of inexpensive, easily obtainable materials. Likewise, the remaining components, the support member 110, the rotatable dial member 114 and the base panel 116 may be similarly economically and easily formed by, punching, die casting, molding, etc. from various materials, such as, for example, metallic materials, plastic or polymeric materials, etc. to facilitate manufacture and keep the retail cost of the attachment apparatus 100 within the ability of the general public. In an exemplary embodiment, when formed from a plastic material, the components are formed from plastic stock approximately 1/16th of an inch thick.

Figure 3:
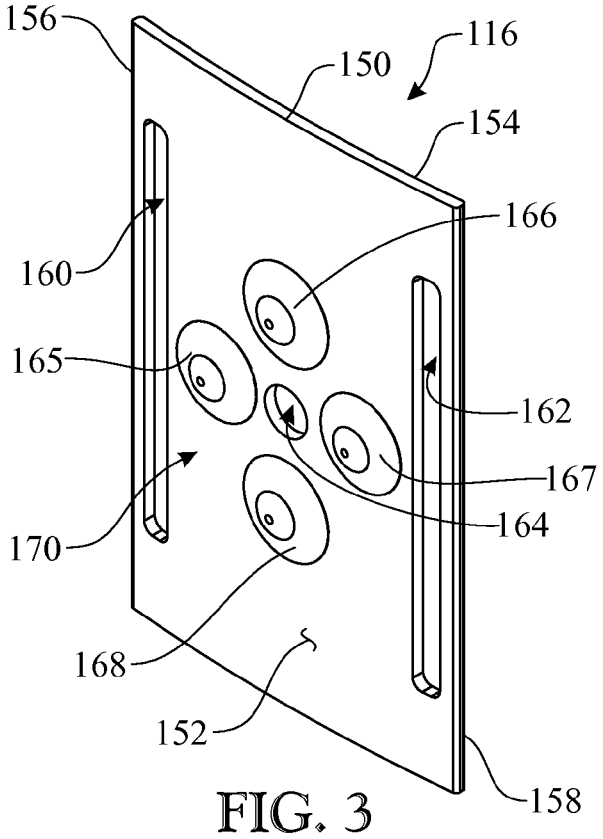
FIG. 3 presents an isometric front view of a rigid base panel of the mobile device attachment apparatus.

Turning now to FIGS. 2 and 3, the base panel 116 is relatively rigid and is secured to the flexible attachment strap 112. The base panel 116 generally includes a body 150 being, for example, of rectangular configuration and having a front surface 152, a rear surface 154, a first side edge 156, and an opposite second side edge 158. A pair of slots, 160 and 162, are provided extending completely through body 150 of base panel 116. Preferably, the slots are provided extending proximate to, and parallel with, the respective aforementioned side edges, 156 and 158, of the base panel body. The base panel body slots 156, 158 are provided for receipt of the strip of flexible material 130 of flexible attachment strap 112 (FIG. 2).

With specific reference to FIG. 3, the base panel 116 additionally includes a central hole 164 for mounting the rotatable dial member 114 and two pairs of raised buttons 165, 167 and 166, 168, extending from the front surface 152 of the rectangular body portion 150. The raised buttons 165, 166, 167 and 168 cooperate with corresponding structure on the rotatable dial member 114 to form a detent-type connection or mechanism 170 allowing the rotatable dial member 114 to be rotated relative to the base panel 116 a full 360° and in discrete increments in a manner described in more detail hereinbelow.

Figure 4:
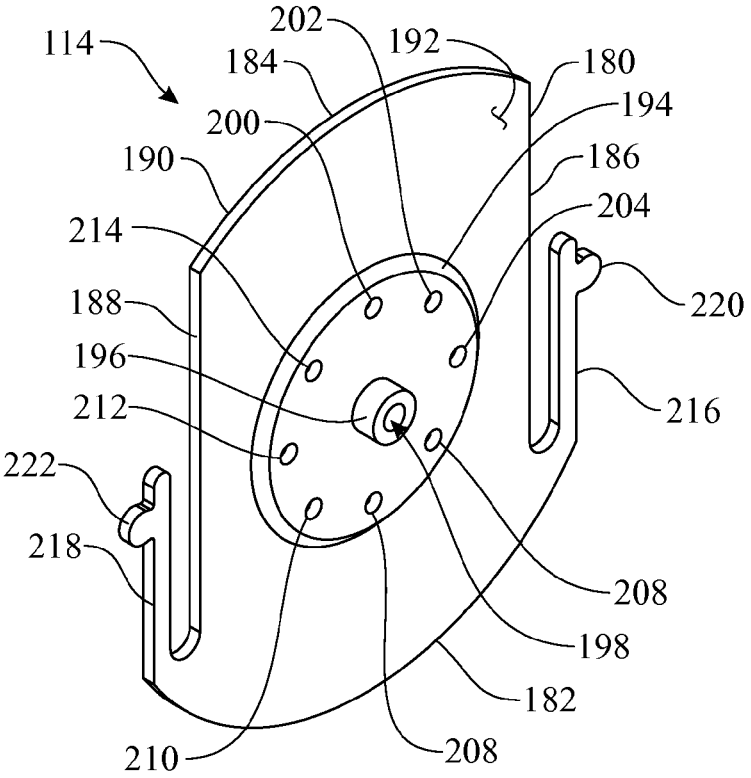
FIG. 4 presents an isometric front view of a rotatable dial member of the mobile device attachment apparatus.

Referring to FIGS. 2 and 4, the rotatable dial member 114 is provided to releasably retain the support member 110 and allow the support member 110 to be rotated relative to the base panel 116. The rotatable dial member 114 generally includes a body 180 having an arcuate first end 182, an arcuate second end 184, a first side 186 and a second side 188 opposite and parallel to the first side. The rotatable dial member additionally has a front surface 190 and a rear surface 192.

As best shown in FIG. 4, a circular, raised central portion 194 projects outwardly from the rear surface 192 of the rotatable dial member body 180. The raised central portion 194 includes a post 196, projecting outwardly from the raised central portion 194, for engagement with the base panel 116 by extension of the post 196 through the central hole 164 in the base panel 116 as identified in FIG. 3. The rotatable dial 114 can be secured to the base panel 116 by means of a screw, rivet or other fastener (not shown) affixed within a central bore 198 of the post 196 and having, for example, a head (not shown) that rotatably overlaps with a countersunk portion of the rear surface 154 of the base panel 116 encircling the hole 164. The raised central portion 194 additionally forms part of the detent mechanism 170 that includes, for example, a plurality of angularly spaced-apart detent holes 200, 202, 204, 206, 208, 210, 212 and 214 defined in the raised central portion 194 for releasable engagement with the raised buttons 165, 166, 167 and 168 extending outwardly from the front surface 152 of body 150 of the base panel 116.

In an exemplary embodiment, the holes 200-214 are spaced 45° apart to allow for discrete 45° rotational increments for bringing respective ones of the holes into alignment with the raised buttons which are spaced 90° apart so as to allow for 360° of rotation with eight angularly-displaced stopping positions of the rotatable dial 114 and support panel 110 therewith relative to the base panel 116. More or fewer holes may be provided to allow for other discrete degrees of rotation. Additionally, the holes need not be equally spaced apart, but may vary in degree of spacing to accommodate a particular set of functions or viewing angle of an electronic device 500. Also the raised buttons 165, 166, 167 and 168 may be strategically placed off center to allow the electronic device 500 to be more easily viewed while wearing the apparatus 100.

With continued reference to FIGS. 2 and 4, and as noted hereinabove, the rotatable dial 114 not only allows the support member 110 to be rotated relative to the base panel 116 but, additionally, releasably retains the support member 110 by means of a releasable attachment mechanism which includes first and second flexible arms 216 and 218 on the rotatable dial 114 which extend from the first arcuate end 182 toward the second arcuate end 184 of the body 180 and are spaced apart from the first and second parallel sides 186 and 188, respectively. The first flexible arm 216 terminates in a first outwardly projecting tab 220 and the second arm 218 terminates in a second outwardly projecting tab 222. The first and second flexible arms 216 and 218 are actuatable by a user to releasably engage the support member 110 in a manner described hereinbelow.

Figure 5:
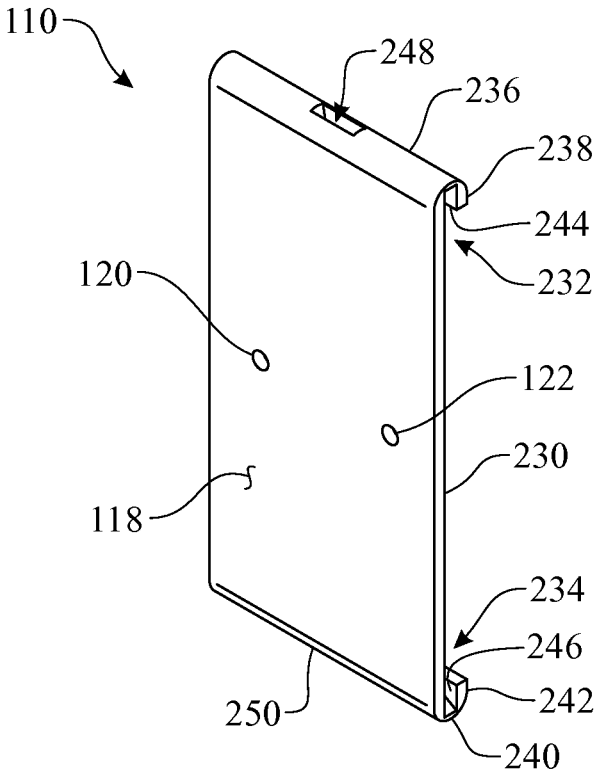
FIG. 5 presents an isometric front view of a support member of the mobile device attachment apparatus.

Referring now to FIGS. 2 and 5, the support member 110 includes a support member body 230 having the flat surface 118 and the holes 120 and 122 to retain an electronic device 500. The support member body 230 also has a first end 232 and an opposite second end 234. The first end 232 includes a first edge 236 and a first inwardly directed lip 238 extending from the first edge 236. Similarly, the second end 234 includes a second edge 240 and a second inwardly directed lip 242. The aforementioned releasable attachment mechanism also includes a first channel 244 defined at the first end 232 of the support member body 230 and a second channel 246 defined at the second end 234 of the support member body. The first and second channels 244 and 246 of the device support member 110 are provided to receive the first and second flexible arms 216 and 218, respectively, of the rotatable dial member 114. In order to secure the first and second flexible arms 216 and 218 of the rotatable dial member 114 to the device support member 110, the first and second edges 236 and 240 of the device support member 110 are provided with respective first and second notches 248 and 250 that will receive the outwardly projecting tabs 220 and 222 of the first and second flexible arms. The user first aligns the first and second channels 244 and 246 of the support member 110 with the first and second flexible arms 216 and 218 of the rotatable dial member 114. The user then manually moves the support member 110 relative to the first and second flexible arms 216 and 218 causing the latter to enter the first and second channels 244 and 246 such that the first and second arms are flexed or depressed from their normal position shown in FIG. 2 toward the first and second parallel sides 186 and 188 of the dial member 114 as the support member 110 is slid over the dial member 114 preferably from the arcuate first edge 184 thereof until the first and second outwardly projecting tabs 220 and 222 of the first and second flexible arms 216 and 218 of the rotatable dial member 114 are aligned with the first and second notches 248 and 250 of the support member 110, whereupon the first and second flexible arms 216 and 218 are released and then automatically return to their normal non-flexed position as their first and second tabs 220 and 222 enter and are releasably retained within the first and second notches 248 and 250 in snap fit fashion.

Figure 11:
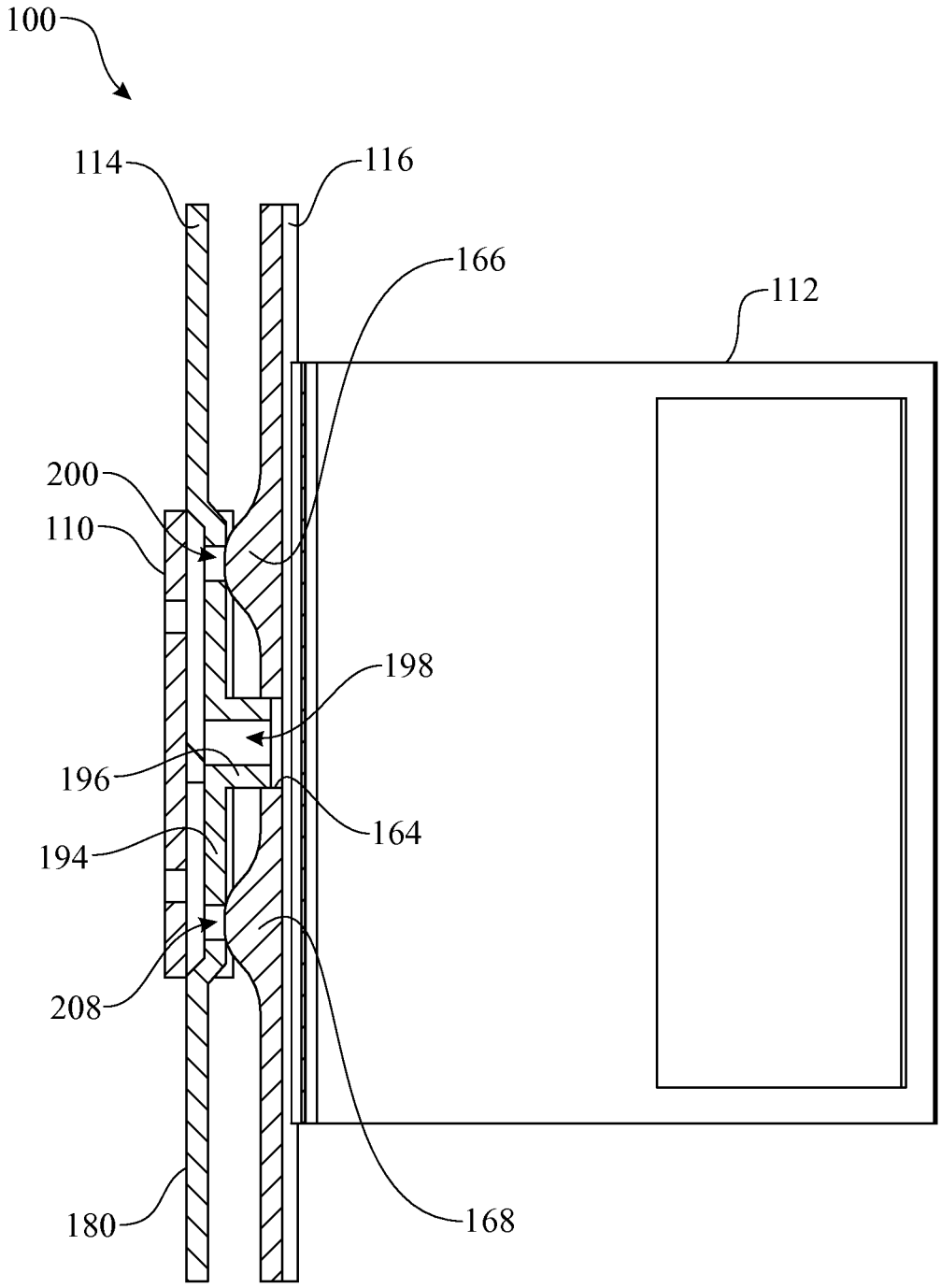
FIG. 11 presents an enlarged sectional view of the assembled mobile device attachment apparatus taken along line 11-11 in FIG. 6.
Figure 12:
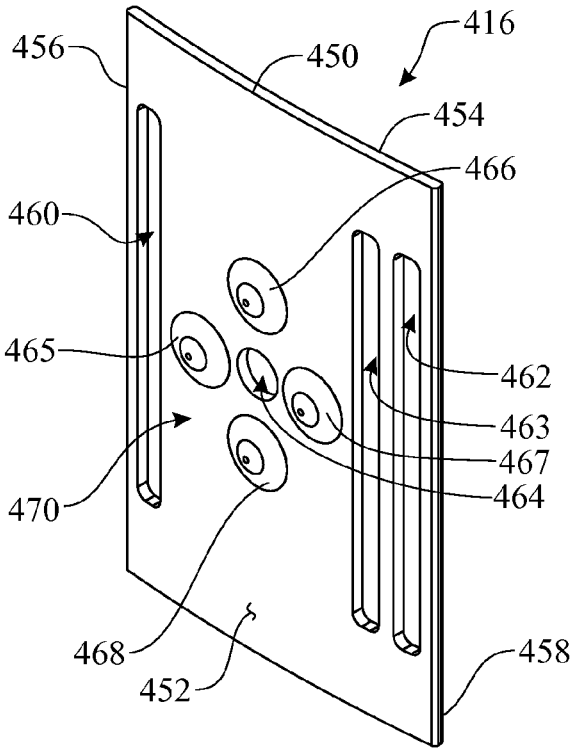
FIG. 12 presents an isometric front view of an exemplary embodiment of an alternative base panel.
Figure 13:
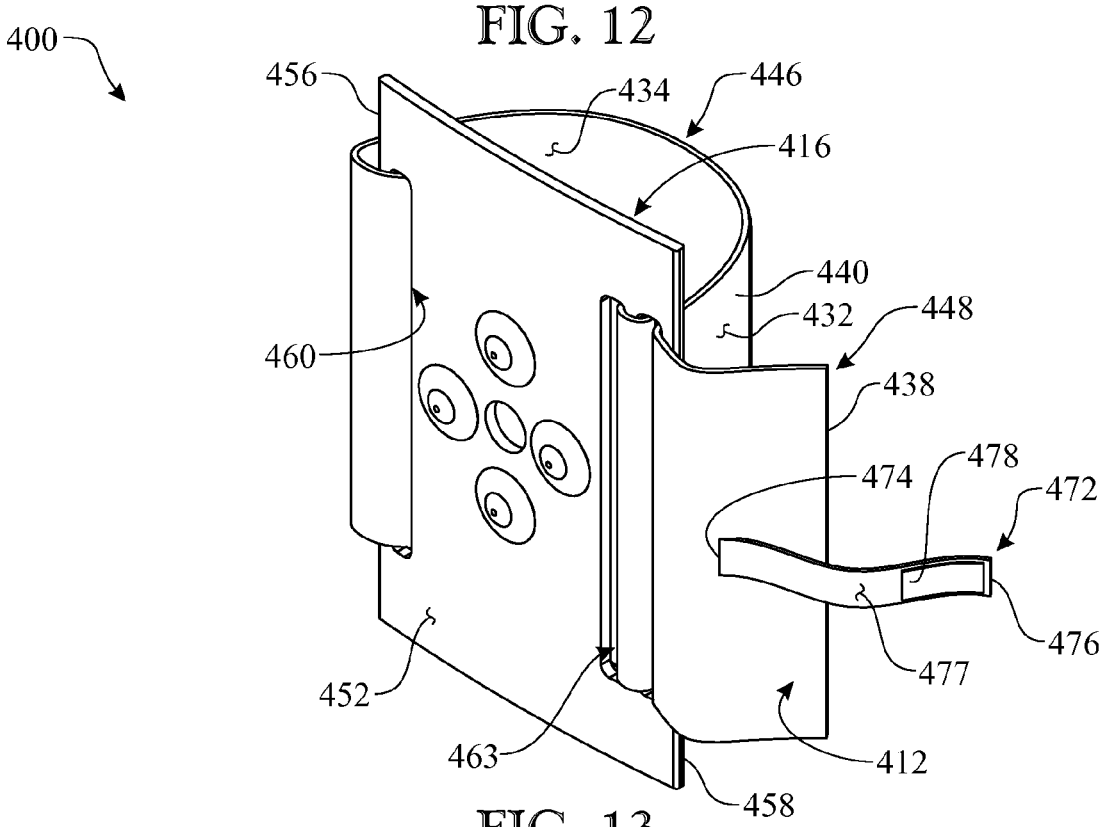
FIG. 13 presents an isometric front view of an alternative embodiment of the assembled mobile device attachment apparatus utilizing the alternative base panel originally introduced in FIG. 12 and not showing the dial and support members of the apparatus.
Figure 14:
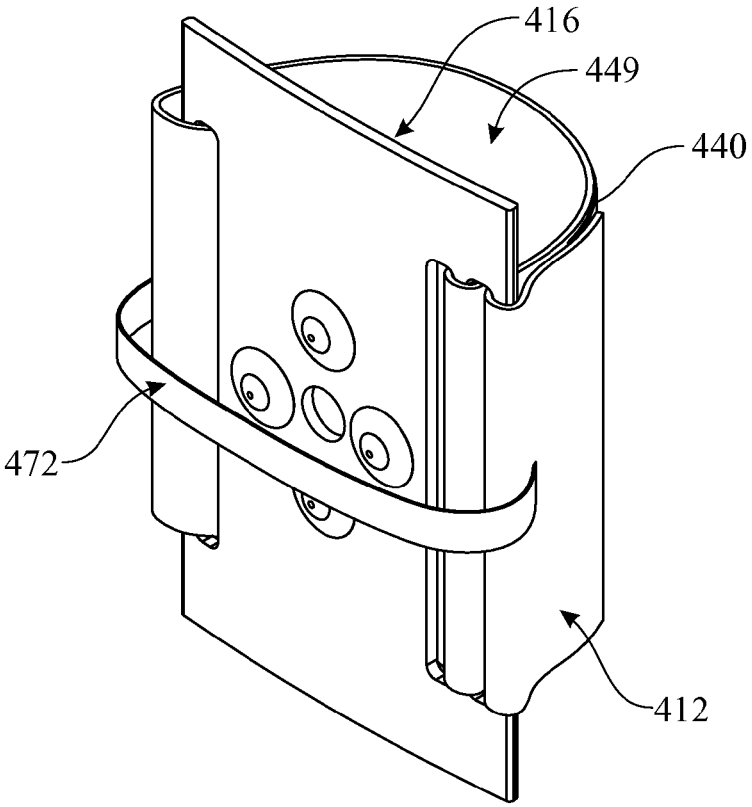
FIG. 14 presents an isometric front view of the assembled mobile device attachment apparatus of FIG. 13, illustrating a fastened security strap employed by the apparatus.

With reference to FIGS. 2, 3 and 11, to assemble attachment apparatus 100, the base panel 116 is mounted on the flexible attachment strap 112 by threading the strip of flexible material 130 through the slots 160 and 162 in the base panel 116. The rotatable dial member 114 is rotatably mounted to the base panel 116 by inserting the post 196 through the central hole 164 in the base panel 116. A screw or other fastener (not shown) is affixed within the bore 198 of the post 196 to secure the rotatable dial member 114 to the base panel 116. It may be desirable to utilize a flat or round head fastener (not shown) and countersink the rear surface 154 of the base panel 116 around the area of the central hole 164 to minimize any irritation from the head of the fastener through the strip of flexible material 130 and against the skin of the user.

As best shown in FIG. 11, when the rotatable dial 114 is affixed to the base panel 116, raised buttons 166 and 168, along with raised buttons 165 and 167 (not shown), engage diametrically opposed holes in the raised central portion 194 of rotatable dial member 114. For example, as shown, the raised buttons 166 and 168 engage the diametrically opposed holes 200 and 208 in the raised central portion 194 and, as not shown, the raised buttons 165 and 167 engage the diametrically opposed holes 204 and 212. The flexible nature of the material forming the body portion 180 of the rotatable dial member 114 allows the raised central portion 194 to flex away from the raised buttons 165, 166, 167 and 168 as the rotatable dial member 114 is rotated relative to the base panel 116.

Referring now to FIGS. 2, 4 and 5, to assemble the support member 110 to the rotatable dial 114, the support member 110 is slid over the first and the second flexible arms 216 and 218 as described hereinabove. Specifically, the support member 110 is positioned such that the first channel 244 is advanced over the depressed first flexible arm 216 of the rotatable dial member 114 and the second channel 246 of the support member 110 is advanced over the depressed second flexible arm 218 of the rotatable dial member 114. The support member 110 is continued to be slid over the rotatable dial member 214 until the first and second outwardly projecting tabs 220 and 220 of the first and second flexible arms 216 and 218 are brought into alignment with the first and second notches 248 and 250 in the support member 110. The bias of the depressed first and second flexible arms 216 and 218 causes them to automatically return to unflex conditions when their first and second outwardly projecting tabs 220 and 222 enter into and make a snap-fit locking engagement with the first and second notches 248 and 250 in the support member 110.

As noted hereinabove, the support member 110 is releasably attached to the rotatable dial member 114. In order to remove the support member 110 from the rotatable dial member 114, the first and second outwardly projecting tabs 220 and 222 are pushed back through the first and second notches 248 and 250 in the support member 110 to unlock or release the support member 110 from the snap-fit locking engagement with the rotatable dial member 114. Thereafter, the support member 110, including any attached electronic device 500, may be slid back off of the rotatable dial member 114 to use the electronic device 500 separate from the remainder of the attachment apparatus 100.

Figure 6:
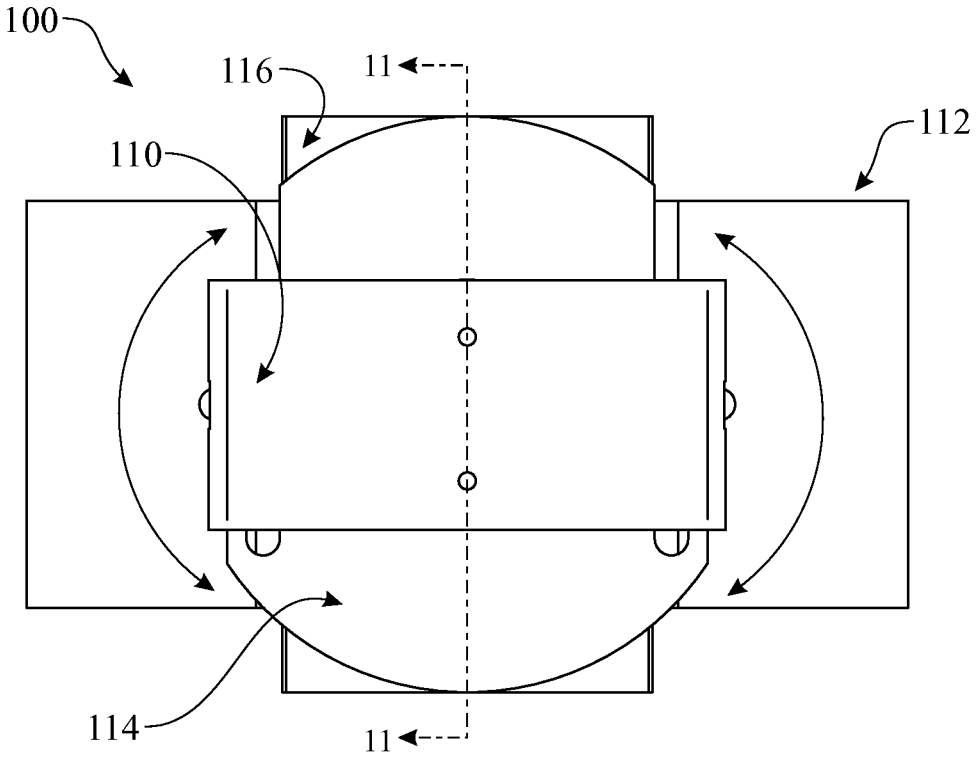
FIG. 6 presents a front elevational view of the assembled mobile device attachment apparatus.
Figure 7:
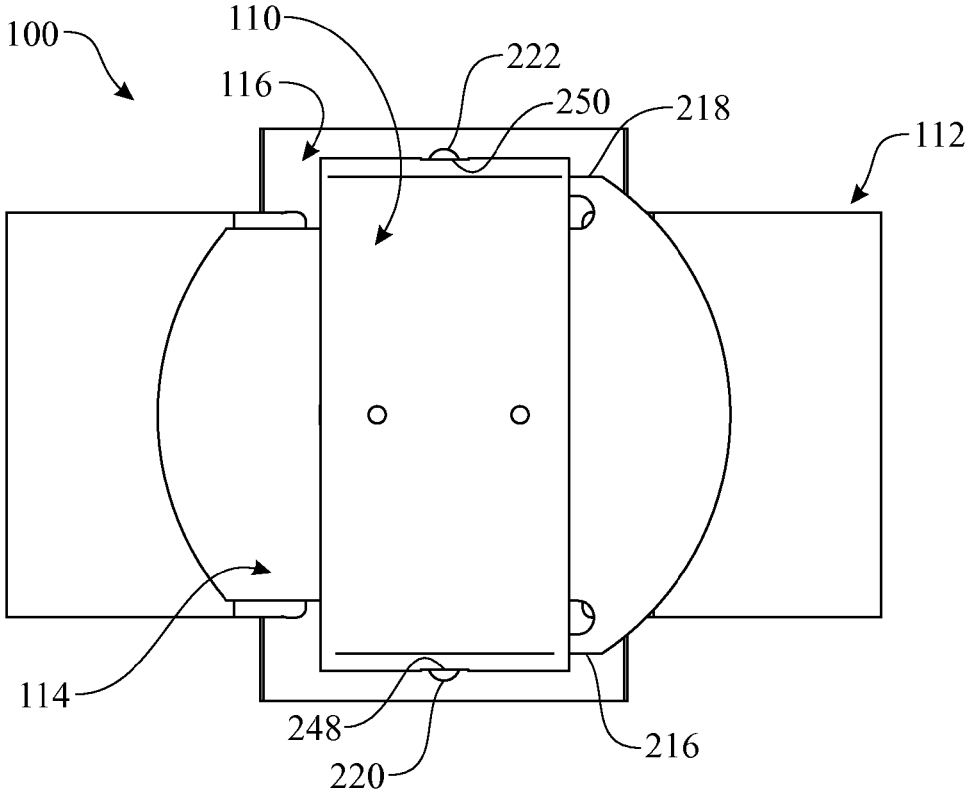
FIG. 7 presents another front elevational view of the assembled mobile device attachment apparatus, after the dial and support members thereof have been rotated counterclockwise 90 degrees from their configuration with the base panel of the apparatus illustrated in FIG. 6.
Figure 8:
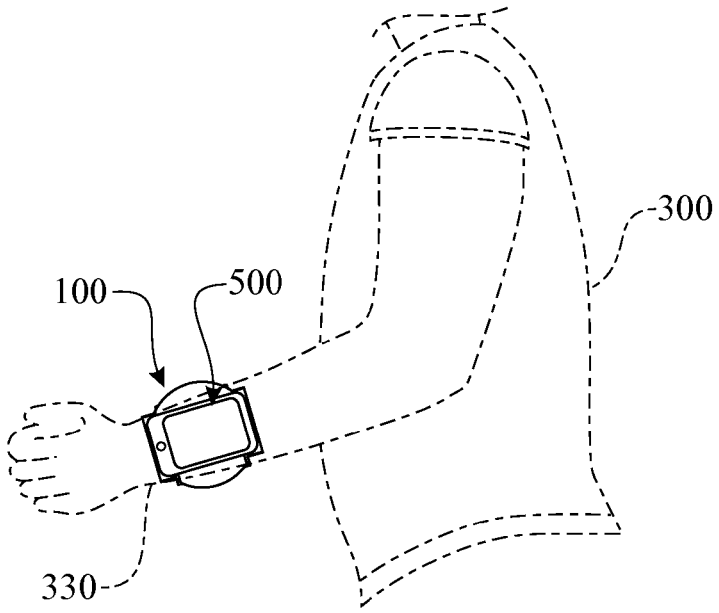
FIG. 8 presents a front view of the assembled mobile device attachment apparatus in use on a user's wrist.
Figure 9:
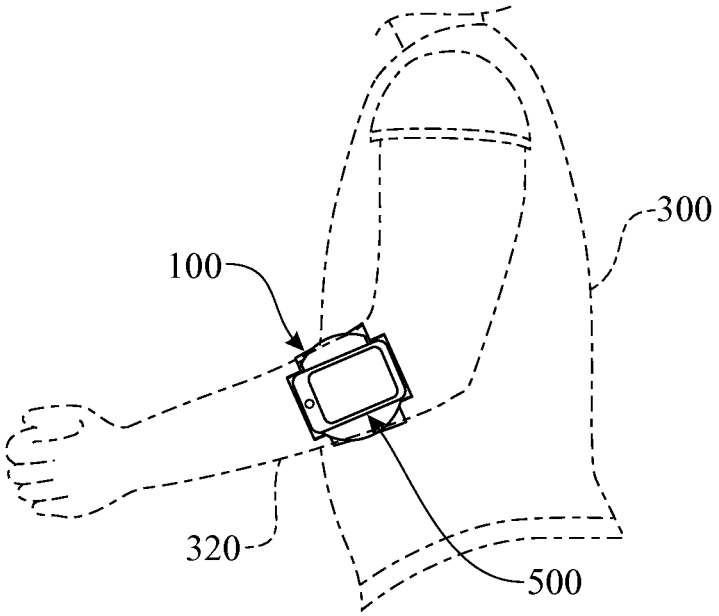
FIG. 9 presents a front view of the assembled mobile device attachment apparatus in use on a user's forearm.

As best shown in FIGS. 6 and 7, the rotatable dial member 114, and the support member 110 (including an attached electronic device 500) therewith, may be rotated relative to the base panel 116 to orient a viewing screen or controls of an attached electronic device 500. For example, the rotatable dial member 114 may be rotated 90° relative to the base panel 116 to change the orientation of a display screen on the electronic device 500 from landscape (FIG. 6) to portrait (FIG. 7).

Figure 10:
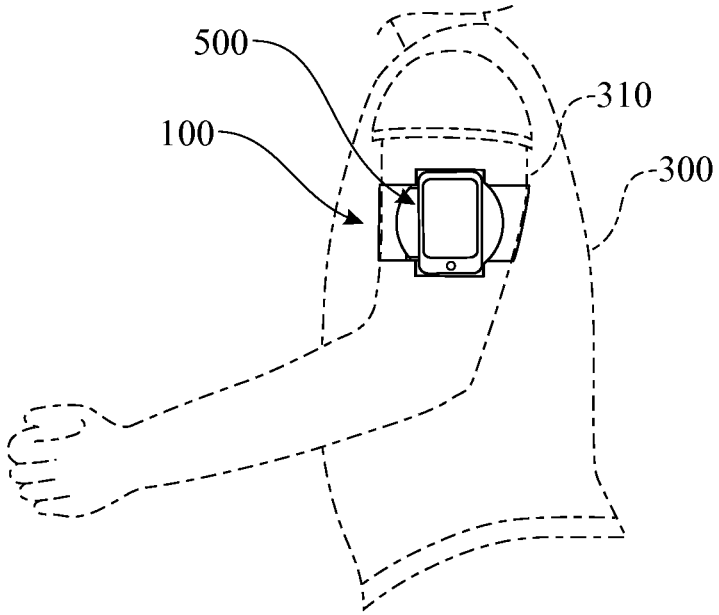
FIG. 10 presents a front view of the assembled mobile device attachment apparatus in use on a user's upper arm.

As noted hereinabove, the flexible attachment strap 112 allows the attachment apparatus to be positioned at various locations on the body of a user. For example, the attachment apparatus 100 may be attached to a wrist 330 of a user 300 (FIG. 8), a forearm 320 of the user 300 (FIG. 9) or an upper arm 310 of the user 300 (FIG. 10). In addition to enabling viewing of the electronic device 500 while it is attached to the attachment apparatus being worn by a user as the user engages in various activities, there are other benefits from having the device 500 attached to the attachment apparatus worn by the user. One such benefit is that the device 500 is elevated above, and thus protected and prevented from being damaged by, spills of a liquid onto a surface, such as of a desk, a table or a bar, as may occur if the device 500 had been placed by the user onto such surface or even held in the user's hand resting on such surface.

Referring now to FIGS. 12-15, an attachment apparatus 400 illustrating a base panel 416 and a flexible attachment strap 412 is presented in an alternative embodiment. Like features of the attachment apparatus 400 and attachment apparatus 100 are numbered the same except preceded by the numeral "4". Although a support member and a rotatable dial member is not illustrated in FIGS. 12-15, for the sake of brevity, it is understood that the support member and the rotatable dial member can be selectively attached to the base panel 416 as described above, with reference to FIGS. 1-11.

The base panel 416 is relatively rigid and is secured to the flexible attachment strap 412. The base panel 416 generally includes a rectangular body 450 being, for example, of rectangular configuration and having a front surface 452, a rear surface 454, a first side edge 456, and a second side edge 458. The first and second side edges, 456 and 458, define a first slot 460 and a second slot 462, respectively. A third slot 463 is also formed within the rectangular body 450 and is adjacent to the second slot 462 and parallel with the slots 460, 462. The slots 460, 462, 463 are for receipt of the flexible attachment strap 412, as will be described below.

The base panel 416 additionally includes a central hole 464 for mounting the rotatable dial member, as described above with reference to FIGS. 1-11, and two pairs of raised buttons 465, 466, 467 and 468, extending from the front surface 452 of the rectangular body 450.

Figure 15:
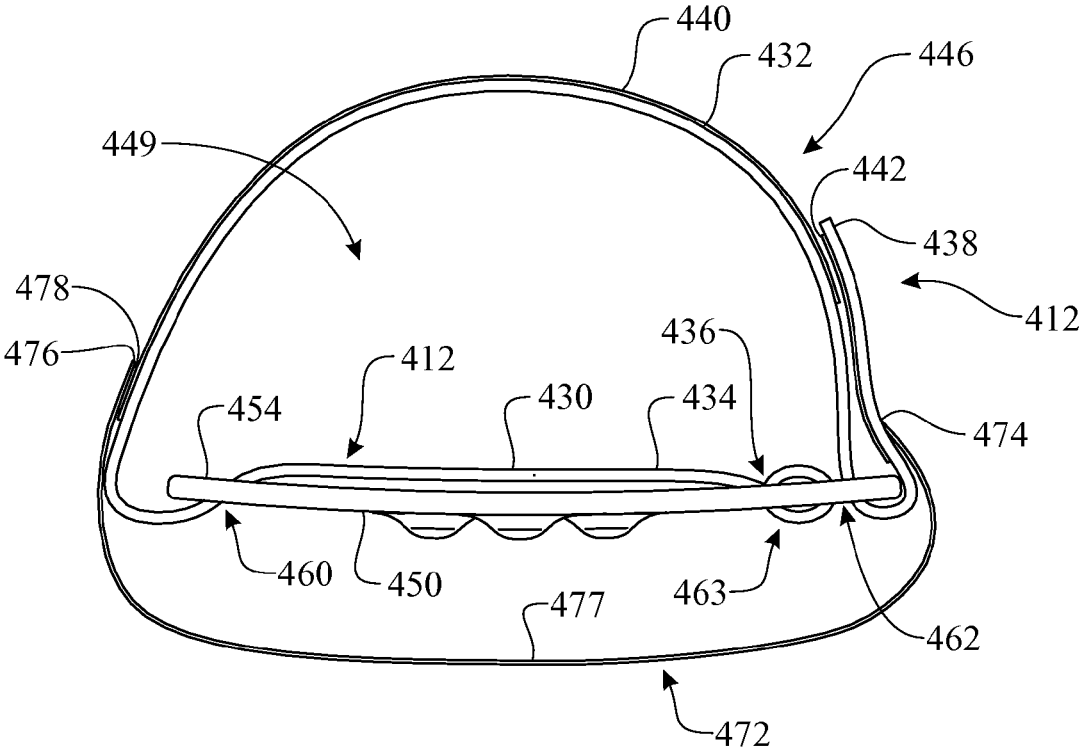
FIG. 15 presents a top plan view of the assembled mobile device attachment apparatus of FIG. 14 with the fastened security strap.

The flexible attachment strap 412 includes a length of strip of flexible material 430 having an outer surface 432, an inner surface 434, a first end 436 and a second end 438. As best illustrated in FIG. 15, the first end 436 is looped through the third slot 463 and the second slot 462 and secured to the inner surface 434 of the flexible material 430. The flexible attachment strap 412 extends along a length of the rectangular body 450, adjacent to the rear surface 454. The strap 412 is then threaded through the first slot 460 and looped around the rear of the rectangular body 450 and threaded through the second slot 462, forming an arm receiving portion 446 and a free attachment portion 448. The free attachment portion 448 is defined by the excess strip of flexible material 430 threaded through the second slot 462. The arm receiving portion 446 defines an opening 449 through which a user's arm can be slideably inserted.

As best illustrated in FIG. 15, a first attachment strap securing member 440 is affixed to the outer surface 432 of the arm receiving portion 446. The first attachment strap securing member 440 is, for example, a strip of loop material for a hook-and-loop type fastener. A second attachment strap securing member 442 is affixed to the outer surface 432 of the free attachment portion 448. The second attachment strap securing member 442 is, for example, a strip of hook material for a hook-and-loop type fastener.

A device security strap 472 includes a first end 474, a second end 476, and an inner surface 477. The first end 474 is affixed to or otherwise integrated into the inner surface 434 of the free attachment portion 448. The second end 476 of the device security strap 472 includes a security strap attachment member 478 affixed thereon. The security strap attachment member 478 can be, for example, a strip of hook material for a hook-and-loop fastener.

As best illustrated in FIG. 15, in order to releasably secure the attachment apparatus 400 about the arm of the user, the second attachment strap securing member 442, disposed on the outer surface 432 of the free attachment portion 448, is releasably connected to first attachment strap securing member 440, which is disposed on the outer surface 432 of the arm receiving portion 446. The device security strap 472 can be wrapped around a device, such as a mobile device, affixed to the attachment apparatus 400 (as described above with reference to FIGS. 1-11), and the second end 476 can be secured by selectively engaging the security strap attachment member 478 to the first attachment strap securing member 440, disposed on the arm receiving portion 446. In this manner, the attachment apparatus 400 can be immovably secured about the arm of the user and the mobile device can be secured to the apparatus 400 so as to prevent rotation of the rotatable dial member, and the support member and the device therewith, relative to the base panel 416 of the apparatus 400.

Figure 16:
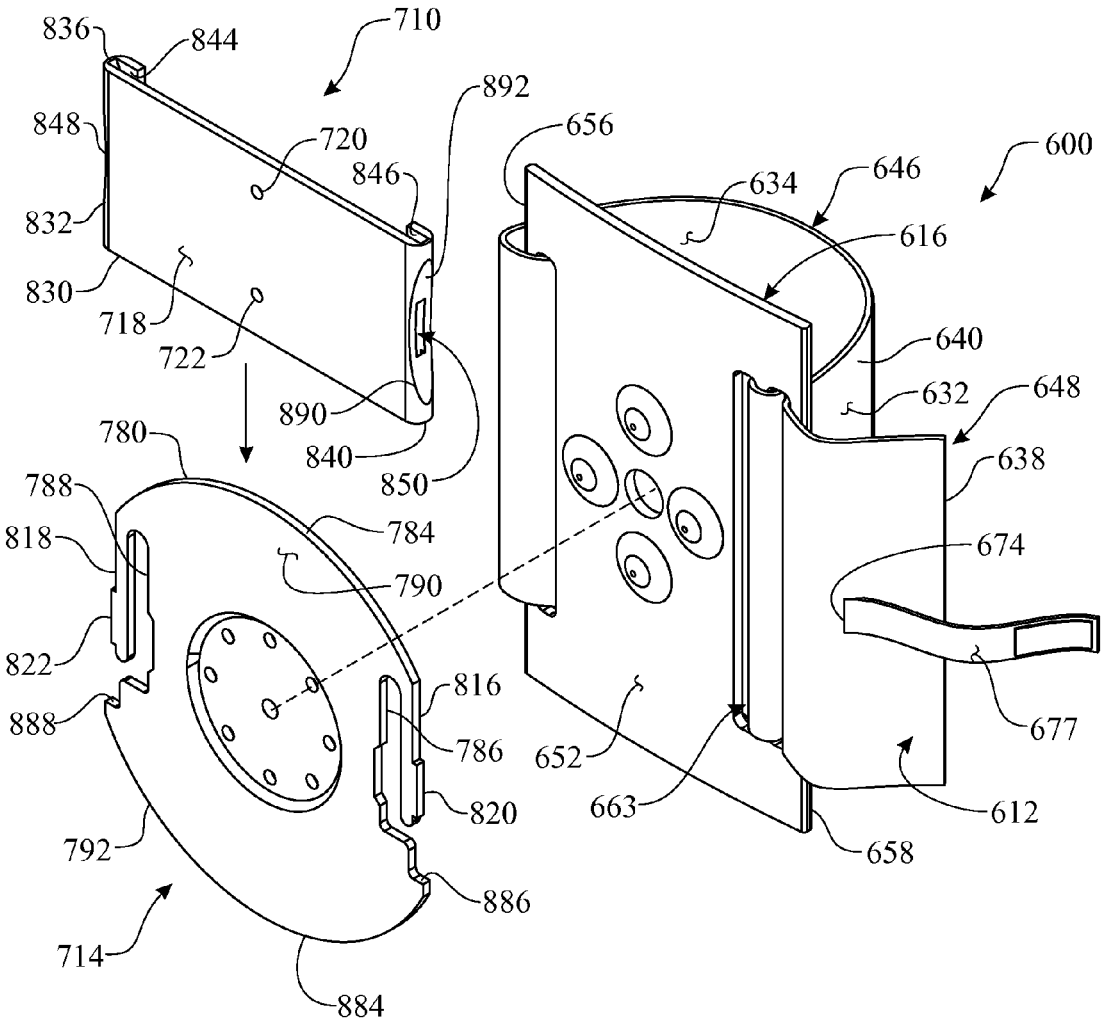
FIG. 16 presents an isometric exploded view of the exemplary mobile device attachment apparatus.

Referring now to FIG. 16, an alternate attachment apparatus 600 illustrating a rotatable dial 714 and a support member 710 is presented in an alternative implementation of the invention. Like features of the rotatable dial 714 and rotatable dial 114 are numbered the same, except preceded by the numeral "7" or "8". Accordingly, like features of the support member 710 and support member 110 are numbered the same except preceded by the numeral "7" or "8". In order to assemble the support member 710 to the rotatable dial 714, the support member 710 can be held by gripping indentations 892, which provide a concave surface 892 on top of rounded edge 890.

As noted hereinabove, in order to secure the rotatable dial member 714 to the support member 710, the first and second edges, 836 and 840, respectively, of the support member 710 are provided with respective first and second notches, 848 and 850, respectively. The first and second flexible arms, 816 and 818, respectively, of the rotatable dial member 714 are aligned with the first and second channels 844 and 846 of the support member 710, and then manually flexed or depressed by a user from their normal non-biased position shown in FIG. 16 toward the first and second parallel sides 786 and 788 of the dial member 714, as the support member 710 is slid over the dial member 714 preferably from the arcuate first edge 784 thereof until the first and second outwardly projecting tabs 820 and 822 of the first and second flexible arms 816 and 818 of the rotatable dial member 714 are aligned with the first and second notches 848 and 850 of the support member 710. Substantially concurrently, the leading ends of the first and second edges 836 and 840 are stopped by shoulders 886 and 888 formed in the dial member 714 in aligned spaced relationships to the first and second flexible arms 816 and 818, whereupon flexible arms 816 and 818 are released and automatically return to their normal non-flexed position as their first and second tabs 820 and 822 enter and are releasably retained within the first and second notches 848 and 850 in snap fit fashion.

To recap in view of the foregoing description, the attachment apparatus constitute a low profile, rotational, clip and release, functional, armband-type platform for smart phones and MP3 players that can be worn on the wrist area, forearm and upper arm areas of a user, during participation by the user in other separate activities, even vigorous activities such as running, biking, walking, etc. The attachment apparatus allows full use of smart phone or MP3 player functionalities while being so worn by the user.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A mobile device attachment apparatus, comprising:

a flexible attachment strap adapting the apparatus to be worn by a user;

a base panel coupled to said flexible attachment strap;

a dial member comprising a body having a pair of opposite side portions and opposite front and rear surfaces extending between said opposite side portions such that said dial member body is rotatably mounted, and disposed adjacent, to said base panel with said rear surface of said dial member body facing said base panel, said dial member body having a pair of flexible arms with outwardly projecting tabs thereon and mounted to said dial member body and respectively extending along and in a spaced-apart relationship to said opposite sides of said dial member body, said flexible arms adapted to be flexed toward said opposite sides of said dial member body as channels of a support member body are slid over said flexible arms of said dial member until said outwardly projecting tabs on said flexible arms are aligned with and releasably retained within respective notches of said support member so as to releasably mount said support member on said dial member, and wherein said dial member body has a pair of opposite shoulders respectively on said opposite side portions of said dial member body aligned with and spaced-apart from said outwardly projecting tabs on said flexible arms such that said opposite shoulders are contacted by respective ends of opposite edges of said support member concurrently with said tabs on said flexible arms being released within said respective notches of said support member;

said support member, which comprises a body having a pair of opposite edges and opposite front and rear surfaces extending between said opposite edges such that said front surface of said support member body provides a platform and said rear surface of said support member body faces said front surface of said dial member body, wherein said pair of opposite edges of said support member body define a pair of channels respectively extending along said opposite edges and being open at opposite ends of each of said opposite edges, said support member body also provided with a pair of notches respectively defined through said opposite edges to said channels from exterior of said support member body;

a coupler defined at said front surface of said support member body between and spaced from said opposite edges thereof to retain a mobile electronic device on said platform provided by said front surface of said support member body.

2. The apparatus of claim 1, wherein said base panel includes a body having a pair of opposite side edges each defining at least one slot respectively for receiving said flexible attachment strap therethrough and therebetween so as to thereby flexibly couple said flexible attachment strap to said opposite side edges of said base panel body.

3. The apparatus of claim 1, wherein said base panel includes a body having a central hole therethrough.

4. The apparatus of claim 3, wherein said dial member body has a central post mounted thereon, said central post extending through said central hole of said base panel body and being rotatably secured to said base panel body so as to rotatably mount said dial member on said base panel.

5. A mobile device attachment apparatus, comprising:

a flexible attachment strap adapting the apparatus to be worn by a user;

a base panel coupled to said flexible attachment strap;

a dial member comprising a body having a pair of opposite side portions and opposite front and rear surfaces extending between said opposite side portions such that said dial member body is rotatably mounted, and disposed adjacent, to said base panel with said rear surface of said dial member body facing said base panel, said dial member body having a pair of flexible arms with outwardly projecting tabs thereon and mounted to said dial member body and respectively extending along and in a spaced-apart relationship to said opposite sides of said dial member body, said flexible arms adapted to be flexed toward said opposite sides of said dial member body as channels of a support member body are slid over said flexible arms of said dial member until said outwardly projecting tabs on said flexible arms are aligned with and releasably retained within respective notches of said support member so as to releasably mount said support member on said dial member, and wherein said dial member body has a pair of opposite shoulders respectively on said opposite side portions of said dial member body aligned with and spaced-apart from said outwardly projecting tabs on said flexible arms such that said opposite shoulders are contacted by respective ends of opposite edges of said support member concurrently with said tabs on said flexible arms being released within said respective notches of said support member;

a detent mechanism defined by and extending between said front surface of said base panel body and said rear surface of said dial member body, and spacing the front surface of said base panel body and said rear surface of said dial member body, so as to enable incremental rotation of said dial member relative to said base panel and thereby positioning said dial member at any selected one of a plurality of angular positions relative to said base panel;

said support member, which comprises a body having a pair of opposite edges and opposite front and rear surfaces extending between said opposite edges such that said front surface of said support member body provides a platform and said rear surface of said support member body faces said front surface of said dial member body, wherein said pair of opposite edges of said support member body define a pair of channels respectively extending along said opposite edges and being open at opposite ends of each of said opposite edges, said support member body also provided with a pair of notches respectively defined through said opposite edges to said channels from exterior of said support member body;

a coupler defined at said front surface of said support member body between and spaced from said opposite edges thereof to retain a mobile electronic device on said platform provided by said front surface of said support member body.

6. The apparatus of claim 5, wherein said detent mechanism includes a plurality of detent holes defined in one of said rear surface of said dial member body and said front surface of said base panel body and a plurality of raised buttons defined on and projecting from the other of said rear surface of said dial member body and said front surface of said base panel body and correspondingly toward said front surface of said base panel body and said rear surface of said dial member body for engagement with a selected array of said plurality of detent holes so as to place said dial member body at a selected one of a plurality of angular positions on and relative to said base panel body.

7. The apparatus of claim 6, wherein said detent holes are spaced apart so as to allow for discrete degrees of rotation of said dial member body between said angular positions on and relative to said base panel body.

8. The apparatus of claim 7, wherein said detent holes are spaced apart at 45° increments.

9. The apparatus of claim 6, wherein said raised buttons are spaced apart at 90° increments.

10. The apparatus of claim 6, wherein said base panel body has a central hole therethrough and said plurality of raised buttons defined on said front surface of said base panel body.

11. The apparatus of claim 10, wherein said dial member body has a central post mounted on said rear surface of said dial member body, said central post extending through said central hole of said base panel body and being rotatably secured to said base panel body so as to rotatably mount said dial member body to and spaced from said base panel body.

12. The apparatus of claim 11, wherein said rear surface of said body of said dial member also has said plurality of detent holes defined therein radially spaced from and surrounding said central post.

13. The apparatus of claim 12, wherein said rear surface of said body of said dial member has a raised central portion projecting toward said front surface of said body of said base panel and including said plurality of detent holes and said central post.

14. The apparatus of claim 5, further comprising:

a device security strap being affixed at opposite ends to spaced portions of said flexible attachment strap and adapted to be wrapped by the user around the mobile electronic device to secure the device on said platform of said support member so as to prevent rotation of said dial member, and said support member and the device therewith, relative to said base panel.

15. The apparatus of claim 5, wherein said base panel body defines a single slot at one of said opposite side edges and a pair of slots at the other of said opposite side edges respectively for receiving said flexible attachment strap therethrough and therebetween so as to thereby couple said base panel on said flexible attachment strap.

* * * * *